166-66
8/24/82 OR SR 4,345,647

United States Patent [19]

Carmichael

[11] 4,345,647

[45] Aug. 24, 1982

[54] APPARATUS TO INCREASE OIL WELL FLOW

[76] Inventor: William C. Carmichael, 3806 N. Stratford Rd., NE., Atlanta, Ga. 30342

[21] Appl. No.: 169,943

[22] Filed: Jul. 18, 1980

[51] Int. Cl.[3] ..... E21B 23/06; E21B 33/127; E21B 43/18; E21B 47/04

[52] U.S. Cl. ..... 166/66; 166/68.5; 166/189; 166/250; 166/370

[58] Field of Search ..... 166/250, 253, 314, 53, 166/66, 68, 68.5, 187, 189, 370

[56] References Cited

U.S. PATENT DOCUMENTS

| | | | |
|---|---|---|---|
| 47,133 | 4/1865 | Root | 166/68.5 |
| 1,547,197 | 7/1925 | Arbon | 166/314 |
| 2,593,497 | 4/1952 | Spearow | 166/68 X |
| 2,604,850 | 7/1952 | Carlin et al. | 166/68.5 |
| 2,624,410 | 1/1953 | Nixon | 166/314 X |
| 2,988,998 | 6/1961 | Wilkinson | 166/314 X |
| 3,393,744 | 7/1968 | Fagg et al. | 166/187 |
| 3,493,045 | 2/1970 | Bassani | 166/187 |
| 3,897,822 | 8/1975 | Mott | 166/189 X |
| 3,952,799 | 4/1976 | Simpson | 166/187 X |
| 4,187,912 | 2/1980 | Cramer | 166/314 |

FOREIGN PATENT DOCUMENTS

| | | | |
|---|---|---|---|
| 352972 | 4/1961 | Switzerland | 166/314 |

*Primary Examiner*—James A. Leppink
*Assistant Examiner*—George A. Suchfield
*Attorney, Agent, or Firm*—B. J. Powell

[57] ABSTRACT

A method of improving the rate of extraction of oil bearing liquid from an oil well comprising the steps of providing a sump in the well casing below the openings through the casing communicating with the oil bearing formation so that the oil bearing liquid flowing into the casing flows into the sump; removing the oil bearing liquid collected in the sump through an oil lift pipe whose intake is submerged in the oil bearing liquid so that the intake of the oil lift pipe remains submerged in the oil bearing liquid; and imposing a vacuum in the casing at the openings through the casing to the oil bearing formation and above the oil bearing liquid in the sump to increase the flow of oil bearing liquid from the oil bearing formation into the casing through the openings. The application also discloses the apparatus for carrying out the method.

1 Claim, 2 Drawing Figures

APPARATUS TO INCREASE OIL WELL FLOW

BACKGROUND OF INVENTION

There are a number of low volume production oil wells in use today which are commonly known as "stripper" wells. These wells are characterized by their extremely low production rates thereby making them marginal even with the high selling prices presently received for petroleum. Various attempts have been made in the past to increase the production of these stripper wells; however, all of these prior art techniques have been economically prohibitive to be applied to increase of production of these stripper wells. As a result, there is a need to economically increase the production of these stripper wells in order to make them sufficiently attractive economically to be maintained in production.

SUMMARY OF THE INVENTION

These and other problems and disadvantages associated with the prior art are overcome by the invention disclosed herein by imposing a vacuum in the well casing independently of the lift device removing the oil bearing liquid from within the well casing. The vacuum is imposed in such a manner that the oil bearing formation is subjected to a vacuum through the well casing without detrimentally affecting the operation of the lift device removing the oil from the bottom of the well casing. The oil bearing liquid is collected in a sump in the bottom of the well casing in which the intake to the oil lift pipe is submerged so that the oil bearing liquid is removed from the well in conventional manner. The vacuum is imposed above the oil bearing liquid collected in the sump so that the openings through the well casing communicating with the oil bearing formation are subjected to the vacuum to assist in the extraction of the oil bearing liquid from the formation. Preferably, the depth of the oil bearing liquid maintained in the sump is sufficient to keep the intake to the oil lift pipe submerged so that it remains isolated from the vacuum being imposed.

The method of the invention includes the steps of providing a sump in the well casing below the openings through the casing communicating with the oil bearing formation from which the oil bearing liquid is being extracted so that the oil bearing liquid flowing into the casing flows into the sump, removing the oil bearing liquid collected in the sump through an oil lift pipe whose intake is submerged in the oil bearing liquid collected in the sump and at a rate such that the level of oil bearing liquid in the sump remains below the openings through the casing to the oil bearing formation while at the same time the intake to the oil lift pipe remains submerged in the oil bearing liquid, and imposing a vacuum in the casing communicating with the oil bearing formation above the oil bearing liquid collected in the sump to increase the flow of oil bearing liquid from the oil bearing formation into the casing through the openings. The vacuum may be imposed along the length of the casing above the oil bearing liquid collected in the sump or alternatively, the casing may be sealed around the oil lift pipe above the openings to the oil bearing formation and the vacuum imposed between the seal on the casing and the oil bearing liquid collected in the sump.

The apparatus of the invention includes an oil well whose casing extends past the oil bearing formation from which the oil bearing liquid is being extracted and which is closed at its lower end to form a sump therein below the oil bearing formation with openings defined through the casing to the oil bearing formation so that the oil bearing liquid can flow from the oil bearing formation into the sump in the casing. An oil lift device is provided whose oil lift pipe extends along the casing with its intake submerged in the oil bearing liquid collected in the sump. The top of the casing above the ground is connected to a vacuum pump so that a vacuum can be imposed inside the casing above the oil bearing liquid collected in the sump and on the oil bearing formation through the openings in the casing. The rate at which the lift device removes the oil bearing liquid from the sump is adjusted to maintain the oil bearing liquid in the sump sufficiently deep to keep the intake to the oil lift pipe submerged while keeping the level of the oil bearing liquid below the openings in the casing.

These and other features and advantages of the invention will become more clearly understood upon consideration of the following drawings and specification wherein like characters of reference designate corresponding parts throughout the several views and in which:

These figures and the following detailed description disclose specific embodiments of the invention; however, it is to be understood that the inventive concept is not limited thereto since it may be embodied in other forms.

DETAILED DESCRIPTION OF ILLUSTRATIVE EMBODIMENTS

Figure 1:
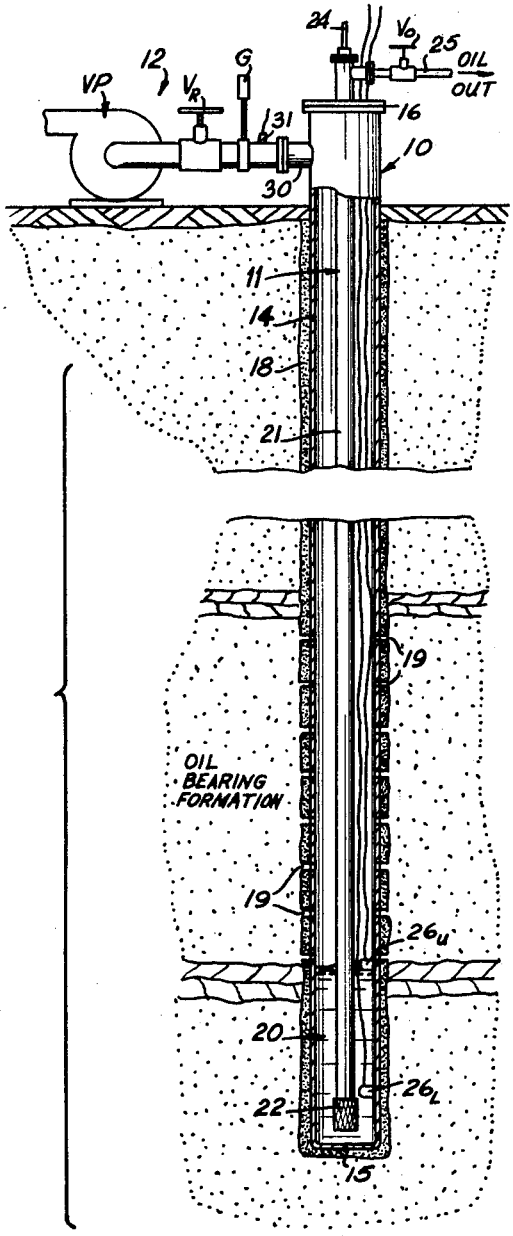
FIG. 1 is a schematic view illustrating the invention incorporated in an oil well.

Referring to FIG. 1, it will be seen that the invention is incorporated in the typical oil well construction used in stripper type wells. The construction includes a well casing 10 which is placed in communication with the oil bearing formation. A lift device 11 is provided inside the casing to lift the oil bearing liquid collected from the oil bearing formation out of the casing. The casing 10 is also connected to a vacuum producing means 12 so that a vacuum can be imposed inside the casing 10.

The oil well casing 10 has an elongate annular side wall 14 closed at its lower end by an end wall 15 and closed at its upper end by an end cap assembly 16. The casing 10 has a length sufficient to extend past the oil bearing formation for a prescribed distance. After the casing 10 is positioned in a pre-drilled opening in the ground, it is set in concrete 18 forced therearound so that the casing 10 is maintained in position. After the casing 10 is in place, openings 19 are formed through the side wall 14 and the concrete 18 therearound in conventional manner so that the interior of the casing 10 is in communication with the oil bearing formation to allow the oil bearing liquid from the formation to flow into the casing through the openings 19. Because the casing 10 extends below the oil bearing formation, the inflowing oil bearing liquid flows down the casing into the sump 20 formed in the lower end of the casing 10.

The lift device 11 is of conventional construction and includes an oil lift pipe 21 which extends down into the casing through the end cap assembly 16. Pipe 21 is provided with an intake 22 adjacent the lower end of the casing 10 so that the intake 22 is located in the sump 20. Because the lift device 11 is of conventional construction, it will not be described in detail. It is understood that a number of different conventional constructions may be used for the lift device 11. Usually, the lift device 11 is of the positive displacement type. In the lift device 11 shown, a reciprocating drive rod 24 extends out of the top of the oil lift pipe 21 so that oil bearing liquid will be lifted from the intake 22 along the oil lift pipe 21 to flow out of the discharge pipe 25 as the rod 24 is reciprocated by conventional means (not shown). The rate at which the oil bearing liquid in the sump 20 is extracted may be controlled with a timer that causes the lift device 11 to be periodically operated so that the level of the oil in the sump 20 is maintained below the level of the intake openings 19 and above the intake 22 to the oil lift pipe 21. Alternatively, upper and lower oil level sensing devices $26_U$ and $26_L$ seen in FIG. 1 may be used in the sump 20 to activate the lift device 11 when the oil bearing liquid reaches the level of sensing device $26_U$ just below the intake openings 19 in casing 10 and deactivate the lift device 11 when the level of oil bearing liquid has been lowered to the sensing device $26_L$ just above the intake 22 to pipe 21. Where the lift device 11 is continuously operated, a flow control valve $V_O$ in the discharge pipe 25 may be used to regulate the rate of removal of the oil bearing liquid in the sump 20 to keep the level between the intake openings 19 through casing 10 and the intake 22 to the oil lift pipe 21.

The upper end of the casing 10 is provided with an auxiliary pipe 30 which communicates with the interior of the casing 10 adjacent the end cap assembly 16. The auxiliary pipe 30 is connected to the intake of a vacuum pump VP through a regulating valve $V_R$ so that the vacuum pump VP imposes a vacuum on the interior of the casing 10 around the oil lift pipe 21 above the oil bearing liquid collected in the sump 20. An appropriate vacuum gage G may be imposed in the line connecting the auxiliary pipe 30 to the vacuum pump VP to be used in adjusting the vacuum imposed in the well casing 10. The regulating valve $V_R$ regulates the amount of vacuum imposed in casing 10 and thus on the oil bearing liquid in the oil bearing formation through the intake openings 19 in casing 10. The vacuum imposed through the openings 19 on the oil bearing liquid in the oil bearing formation serves to increase the flow rate of the oil bearing liquid into the casing 10 through the openings 19. The amount of vacuum imposed by the vacuum producing means 12 is adjusted so that the maximum inflow of the oil bearing liquid into the casing 10 is achieved. This may vary from well to well. In some instances, a sufficient vacuum may be maintained without continuously operating the vacuum pump VP. When this is the case, a vacuum sensing device 31 in communication with the vacuum imposed in casing 10, illustrated in the inlet pipe to pump VP in FIG. 1, may be used to operate pump VP until a prescribed upper vacuum level is reached and then stopping pump BP until the vacuum has dropped to a prescribed lower vacuum level.

The amount of vacuum which can be maintained in the oil well casing 10 will also be limited by the economics of operating the vacuum producing means 12. This, of course, will be in part determined by the particular vacuum pump VP used together with the amount of air flow required to maintain the vacuum. It is anticipated that vacuums up to about ten psi may be practically used.

It will be appreciated that, in some oil wells, the casing 10 may not extend down to the level of the oil bearing formation. The invention can likewise be used in this type well since the hole through the oil bearing formation will usually not be collapsed when the vacuum is imposed.

Figure 2:
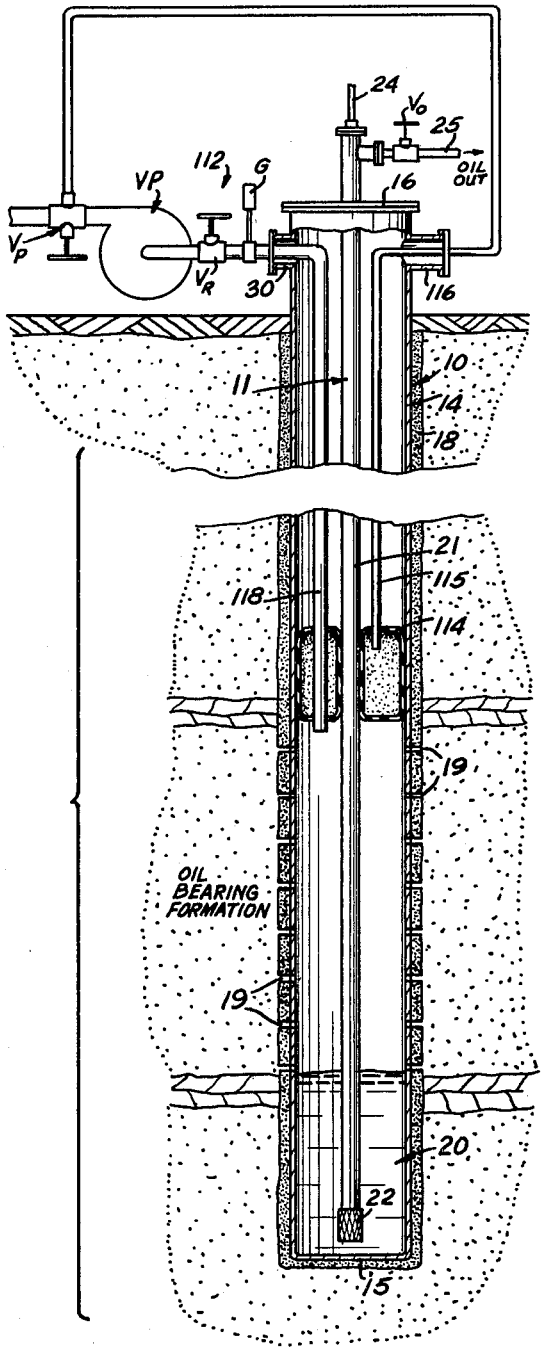
FIG. 2 is a schematic view showing an alternate embodiment of the invention.

Turning now to FIG. 2, an alternate embodiment of the invention is illustrated. Those components of the alternate embodiment of the invention which are the same as with the first embodiment of the invention have like characters of reference applied thereto.

It will be seen that the major difference between the first and alternate embodiments of the invention lies in the vacuum producing means 112. The vacuum producing means 112 seen in FIG. 2 includes an inflatable sealing bladder 114 which is positioned in the side wall 14 of the casing 10 around the oil lift pipe 21. A pressurizing pipe 115 is provided for inflating the bladder 114. The pressurizing pipe 115 extends out through a second auxiliary pipe 116 in the upper end of the well casing 10 adjacent the end cap assembly 16 and is connected to the high pressure output of the vacuum pump VP through a pressure regulating valve $V_P$ so that the pressure in the inflatable bladder 14 can be regulated. The inflatable bladder 114 is lowered into position while it is deflated and the valve $V_P$ manipulated to supply sufficient pressure through the pipe 115 to inflate the bladder 114 to the position seen in FIG. 2 so as to place the bladder 114 in sealing engagement with the oil lift pipe 21 and the inside of the side wall 14 of the casing 10. Usually the bladder 114 is lowered to a position just above the openings 19 to the oil bearing formation and inflated in this position. A vacuum pipe 118 connects with the vacuum pipe $V_P$ through the regulating valve $V_R$ and vacuum gage G via the auxiliary pipe 30 on the well casing 10. The lower end of the vacuum pipe 118 extends through the inflatable bladder 114 in sealing engagement therewith so that the vacuum pump $V_P$ generates a vacuum below the inflatable bladder 114 in the casing 10 which communicates with the oil bearing formation through the hole openings 19.

The oil bearing liquid is collected in the sump 20 in the same manner as that described with the first embodiment of the invention. The oil lift device 11 removes the oil bearing liquid in the same manner as described for the first embodiment.

This construction permits the vacuum to be imposed in only that portion of the well casing having the openings 19 therethrough thus reducing the volume of air which must be extracted from the well casing 10 in order to maintain the vacuum. Also, this does not impose the vacuum in the casing 10 above the openings 19 so that any tendency to collapse the casing 10 is removed.

What is claimed as invention is:

1. An oil well construction for extracting oil bearing liquid from an oil bearing formation in the ground including:

a tubular well casing extending into the ground past the oil bearing formation, said well casing including an upper end extending above the ground and a lower end located below the oil bearing formation, said well casing defining a plurality of openings therethrough communicating with the oil bearing formation so that the oil bearing liquid flows in said casing through said openings, said well casing defining a sump therein between said openings and the lower end of said well casing to collect the oil bearing liquid therein;

lift means for removing the oil bearing liquid from said sump, said lift means including an oil lift pipe extending into said well casing from the upper end thereof, said lift pipe defining an intake thereto located in said sump;

upper liquid level sensing means positioned in said sump in said well casing at a position just below the lowermost of said openings through said well casing and operatively connected to said lift means to cause said lift means to remove the oil bearing liquid from said sump when the level of the oil bearing liquid in said sump rises to the level of said upper liquid level sensing means;

lower liquid level sensing means positioned in said sump in said well casing below said upper liquid level sensing means and at a position just above said intake to said lift pipe and operatively connected to said lift means to cause said lift means to stop the removal of the oil bearing liquid from said sump when the level of the oil bearing liquid in said sump is lowered to the level of said lower liquid level sensing means;

inflatable sealing means positioned in said well casing around said oil lift pipe above said openings through said well casing and;

vacuum producing means including a vacuum pump having a pump inlet and a pump outlet, said pump inlet communicating with the inside of said casing between said sealing means and the oil bearing liquid in said sump to impose a vacuum therein so that said vacuum is imposed on the oil bearing formation through said openings in said well casing to assist in the extraction of the oil bearing liquid from the oil bearing formation and said pump outlet communicating with said inflatable sealing means to inflate said sealing means and seal said well casing around said oil lift pipe above said openings through said well casing.

* * * * *